US005634579A

United States Patent [19]

Baclawski

[11] Patent Number: 5,634,579

[45] Date of Patent: Jun. 3, 1997

[54] BACKPACK WITH INTEGRAL VEST

[76] Inventor: Bonnie M. Baclawski, 311 Jewell Ave., Sebastopol, Calif. 94572

[21] Appl. No.: 506,419

[22] Filed: Jul. 24, 1995

[51] Int. Cl.[6] ..... A45F 3/04

[52] U.S. Cl. ..... 224/637; 224/153; 224/627; 224/643; 224/646; 224/659; 224/660; 2/94; 2/102

[58] Field of Search ..... 224/153, 160, 224/209, 215, 627, 637, 643, 646, 659, 660, 661; 2/94, 102

[56] References Cited

U.S. PATENT DOCUMENTS

| | | | |
|---|---|---|---|
| 2,620,479 | 12/1952 | Buck | 2/94 |
| 2,717,391 | 9/1955 | Bracken | 2/94 |
| 2,970,316 | 2/1961 | Silin | 224/659 |
| 5,361,412 | 11/1994 | Perry | 224/661 |
| 5,465,425 | 11/1995 | Crispin | 2/94 |

FOREIGN PATENT DOCUMENTS

| | | | |
|---|---|---|---|
| 4226964 | 2/1994 | Germany | 224/209 |

*Primary Examiner*—Henry J. Recla
*Assistant Examiner*—Timothy L. Maust
*Attorney, Agent, or Firm*—George W. Wasson

[57] ABSTRACT

A backpack with integral front panel vest-like construction including a front panel, a back panel, a shoulder bib and straps or the like for attaching the front and back portions together. The front panel has a front panel top, a front panel bottom, and two front panel sides. The back panel has a back panel rear backside pack, a back panel top, a back panel bottom, and two back panel sides. The shoulder bib attaches the front panel top and the back panel top, and the shoulder bib has a shoulder bib head opening. Straps attach the front panel sides and the two back panel sides together and secure the backpack to the user.

3 Claims, 2 Drawing Sheets

BACKPACK WITH INTEGRAL VEST

FIELD OF THE INVENTION

This invention relates to a backpack with an integral front pack area and more particularly to a weight distribution construction for a combination backpack with a connected front pack construction.

BACKGROUND OF THE INVENTION

Many sports require tremendous amounts of equipment that must be transported from some staging area to a use area. Some of that equipment can be variable from being bulky and light weight to small and heavy weight, but regardless of size each form of the equipment must be carried to the area of use. For most such uses it is preferable that all of the equipment be carried at one time to avoid having to make two or more trips between the staging area and the use area. A further complication of the transporting of equipment is the terrain that must be crossed between the staging area and the use area; in some cases that terrain involves steep trails, paths, steps or ladders that are best negotiated by the carrier if the carrier has both hands available to assist in the negotiation of the trip. In any and all cases of transporting equipment it is easiest and most comfortable if the weight of the equipment is balanced and distributed over the body of the person carrying the equipment. The present invention accomplishes all of the above desired purposes by providing a backpack with integral front pack area that can be used to carry equipment of many sizes and shapes in conveniently located and distributed positions on the user.

DESCRIPTION OF THE PRIOR ART

U.S. Pat. No. 4,449,655 to Patrick Gerne teaches a combination backpack and gear bag for use by an underwater diver. The backpack is one wherein a container of gas is held on the back of the diver. The gear bag is such that it allows a packpack to be interconnected thereto. Further more, the entire gear bag can be carried as one integral gear bag. The present invention is of a different utility structure from the patent invention.

U.S. Pat. No. 4,669,127 to Richard Swanson teaches a utility garment for load portage in the shape of a vest containing load carrying compartments on the back and front flaps of the vest. The vest closes at the front, and a waist belt is attached to back and front flaps through tie down loops which hold the loaded vest to the wearer to prevent shifting of loads and upward creeping of the front flaps. The waist belt and tie down loops also distribute a portion of the gear load directly to the wearer's hip region. The present invention does not close on the front and utilizes different elements from the above described patented invention.

U.S. Pat. No. 4,793,534 to Berry teaches a modular backpack comprising four compartments which are detachably connected for use individually or in various combinations. The components of the backpack distribute the load about the hip area of the user. The present invention utilizes different structure from the patented invention.

U.S. Pat. No. 5,014,359 to James Hanson teaches a vest and backpack combination. The present invention utilizes different elements and maintains a different utility structure and function from the patented invention.

U.S. Pat. No. 5,247,707 to Parker teaches a utility vest with a pair of straps running through the shoulder areas of the vest terminating in the loops that extend proximate to the outer surface of the garment. The patented invention is a utility vest with an integrally carried pack. The present invention utilizes different elements and maintains a different utility structure and function from the patented invention.

U.S. Pat. No. 5,337,934 to Karen Johnson et al teaches a flipover carrying device for use by a wearer to carry possessions on the wearer's back comprising a back panel supported adjacent to a wearer's back, a noveable pouch and a motion inhibiter. The present invention utilizes different functional elements from the patented invention.

Numerous innovations for combination vests with a backpack have been provided in the prior art that are adapted to be used. Even though these innovations may be suitable for the specific individual purposes to which they address, they would not be suitable for the purposes of the present invention as heretofore described.

SUMMARY OF THE INVENTION

It is an object of the present invention to provide a backpack with an integral front pack or vest like portion that is a balanced pack.

It is a further object of the present invention in accord with the preceeding object to provide a backpack with an integral front panel that distributes the weight of the contents to the front and back of the packpack.

It is a further object of the present invention in accord with the preceeding object to provide a backpack with an integral front panel that is adapted to carry gear wet or dry on the back of the packpack and to carry catch or equipment on the front of the backpack.

It is a further object of the present invention in accord with the preceeding object to provide a backpack with an integral front panel that includes a front panel, a back panel, a shoulder bib and means for adjustably attaching the front and back panels.

It is a further object of the present invention in accord with the preceeding object to provide a backpack with an integral front panel that includes a rear backside pack for carrying gear wet or dry.

It is a further object of the present invention in accord with the preceeding object to provide a backpack with an integral front panel that includes a front panel pouch to carry abalone or other catch wet or dry.

It is a further object of the present invention in accord with the preceeding object to provide a backpack with an integral front panel that gives the user the option to separate catch from gear.

It is a further object of the present invention in accord with the preceeding object to provide a backpack with an integral front panel that is simple and inexpensive to manufacture.

Further objects and features of the present invention will be readily apparent to those skilled in the art from the appended drawings and specification illustrating a preferred embodiment wherein:

LIST OF REFERENCE NUMERALS UTILIZED IN THE DRAWINGS

Figure 4:
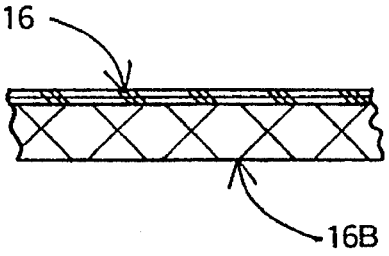
FIG. 4 is a sectional view taken along the lines 4—4 of FIG. 2.

10 backpack with integral front pack 10
12 front panel 12
12A front panel top 12A
12B front panel bottom 12B
12C front panel side 12C
12D front panel pouch 12D
12DA front panel pouch gather tie 12DA
12DAA front panel pouch gather tie cavity 12DAA
12DB front panel pouch extender strip 12DB
14 back panel 14
14A back panel rear backside pack 14A
14AA back panel rear backside pack dual zipper 14AA
14AB back panel rear backside pack dual zipper seam 14AB
14AC back panel rear backside pack loop 14AC
14B back panel top 14B
14C back panel bottom 14C
14D back panel side 14D
14E back panel mesh pocket 14E
14EA back panel mesh pocket strap 14EA
14EB back panel mesh pocket buckle 14EB
14F inside compartment rear backside pack 14F
16 shoulder bib 16
16A shoulder bib head opening 16A
16B shoulder bib padding 16B
16C front end of shoulder bib padding 16C
16D back end of shoulder bib pading 16D
18 means for adjustably attaching 18
18A front panel fastener 18A
18B back panel fastener 18B
20 diver's foot flipers 20
30 article or catch 30

DETAILED DESCRIPTION OF THE PREFERRED EMBODIMENT

Figure 1:
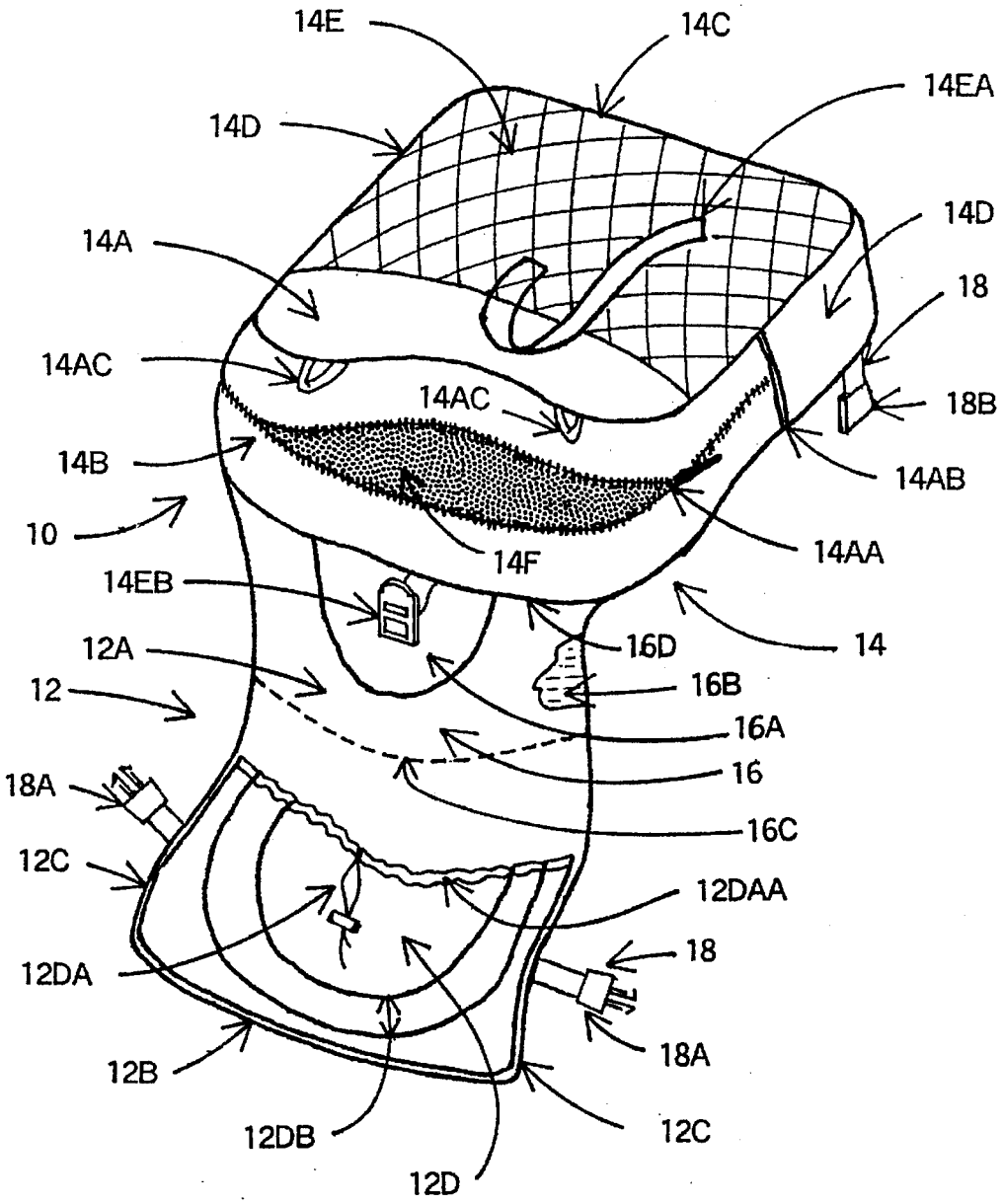
FIG. 1 is a perspective top view of the backpack of the present invention in its generally flat position.
Figure 2:
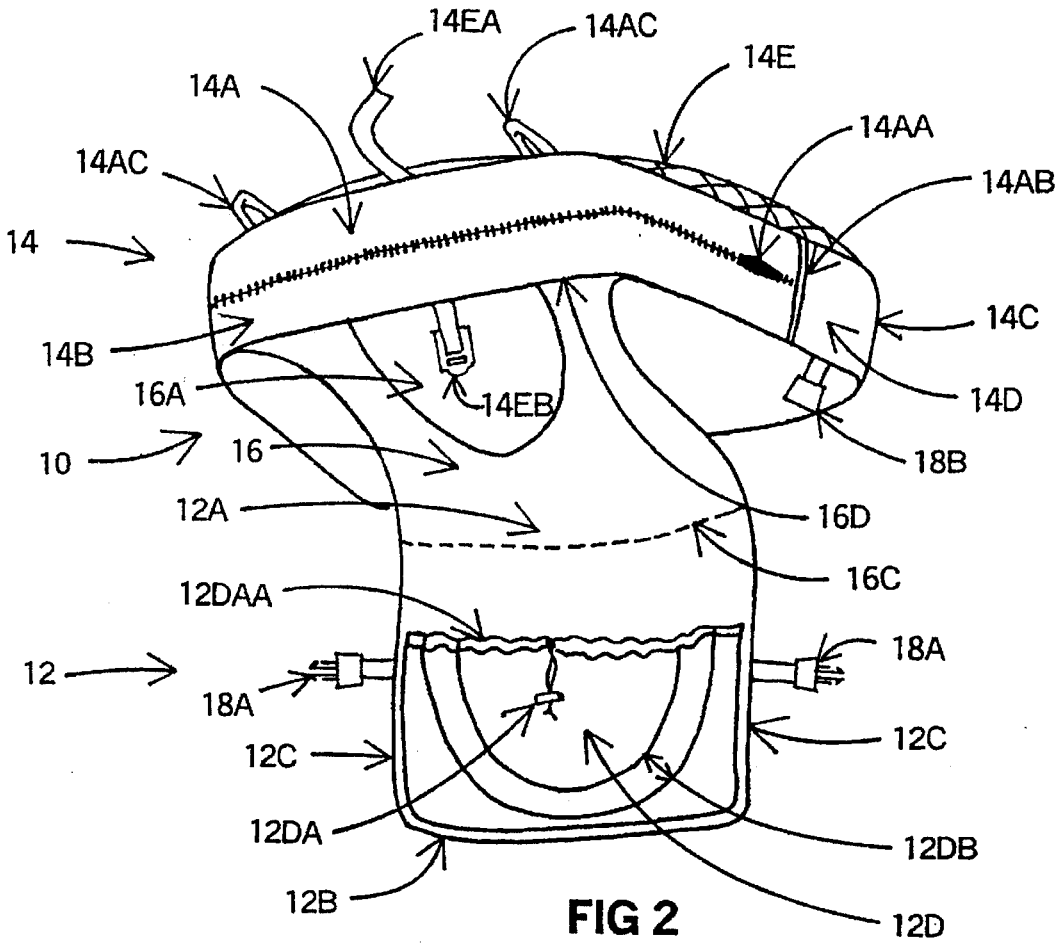
FIG. 2 is a perspective top view of the backpack showing the front and back panel portions.

Now referring to FIGS. 1 and 2 the backpack with integral front portion like a vest contains a front panel 12, a back panel 14, a shoulder bib 16 and a means for adjustably attaching 18 the front panel 12 and the back panel 14. The front panel 12 includes a front panel top 12A, a front panel bottom 12B, two front panel sides 12C and a front panel pouch 12D. The front panel pouch 12D may include a front panel pouch gather tie 12DA disposed within a front panel pouch gather tie cavity 12DAA such that pulling on the front panel pouch gather tie 12DA cinches the front panel pouch 12D. The front panel pouch 12D is attached to the front panel 12 along a front panel pouch extender strip 12DB.

The back panel contains a back panel rear backside pack 14A, a back panel top 14B, a back panel bottom 14C, and two back panel sides 14D. The back panel 14 may further contain a back panel mesh pocket 14E which may include a back panel side pocket strap 14EA and a back panel side pocket buckle 14EB which can cinch the back panel mesh pocket 14E against the back panel 14. The back panel rear backside pack 14A can contain at least one back panel rear backside dual zipper 14AA which extends to a back panel rear backside pack dual zipper seam 14AB, and at least two back panel rear backside pack loops 14AC that are adapted for tying other articles to the backpack.

The shoulder bib 16 contains a shoulder bib head opening 16A. The shoulder bib 16 contains shoulder bib padding 16B suitably secured to the inside of the fabric on the bib 16 as shown in FIG. 4. The shoulder bib 16, front panel 12 and back panel 14 are preferrably one continuous fabric, but could be separate pieces sewn together attaching the front panel top 12A to the back panel top 14B. In FIGS. 1 and 2 the end of the shoulder bib padding 16B is represented by the dotted lines 16C on the front panel top 12A and by 16D on the back panel top 14B.

The means for adjustably attaching 18 attaches the two front panel sides 12C to the back panel sides 14D. The means for adjustably attaching 18 includes a front panel fastener 18A, at each side, and a back panel fastener 18B, at each side. The means for adjustably attaching 18 may be side release clamps or a belt buckle strap apparatus or a clip fastener or any other fastening means selected from the group of fasteners consisting of a clip, side release clamp, belt buckle strap, buttons, push pins, snaps and screw-on means.

The backpack with integral front panel or vest 10 can have an inside layer and an outside layer. The inside layer can be manufactured from soft pliable neoprene and the outside layer manufactured from waterproof nylon. As shown in FIG. 4, the two layers are bonded together. The inside layer of the front panel may be manufactured from a group of soft pliable materials consisting of neoprene, cotton, terry cloth, rubber composites, plastic, plastic composites and natural fibers. The outside layer may be manufactured from a group of waterproof materials consisting of nylon, neoprene, waterproof treated cotton, waterproof treated terry cloth, rubber, rubber composites, plastic, plastic composites and waterproof treated natural fibers.

It will be understood that each of the elements described above, or two or more together, may also find useful applications in other types of constructions differing from the type described above.

Figure 3:
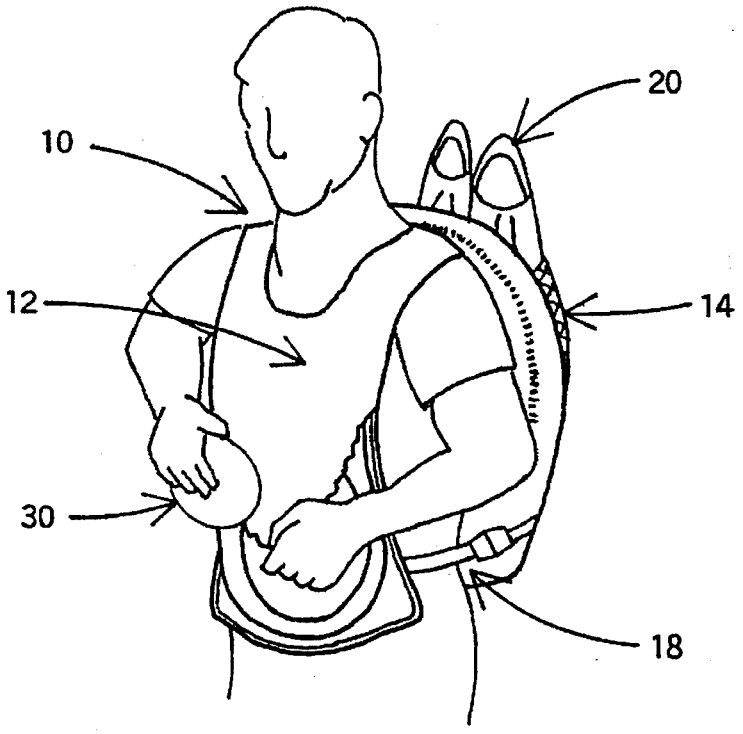
FIG. 3 is a perspective view of the backpack in use on a person.

As illustrated in FIG. 3, the backpack disclosed here permits the user to place the gear to be used in the many pockets and pouches provided in the front and back so as to distribute the load and bulk of the gear. The pockets and pouches may then be cinched by gather ties to hold the gear in place. The front and back panels may then be secured to each other by adjustable attaching means to fit the backpack to the user. With the backpack secured to the user, the user's arms and hands are free to be useful in balance or grasping structures or branches along the travel route.

As further illustrated in FIG. 3, the backpack is further provided with a front pouch for containing wet or dry products or catch so that on a return trip from a use area gear and catch may be separated.

FIG. 3 illustrates the backpack as it could be used by a diver in transporting gear to a dive area. As here illustrated, the diver's feet flippers 20 are in the backpack's back panel mesh pocket 14E and, while not visible in this FIG, the diver's dive suit, mask and snorkel can be secured within the back panel rear backside pack 14F. In the front of the user, there is illustrated the placing of an article or catch 30, such as abalone, into the front panel pouch 12D. As illustrated, the user's arms and hands are free and the backpack load is distributed on the user's body.

While the invention has been illustrated and described as embodied in a backpack with integral front panel or vest, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist ot the present invention that others can, by applying current knowledge, readly adapt it for various applications without limiting features that, from the standpoint of prior art, fairly consitiute essential characteristics of the generic or specific aspects of this invention.

What is claimed as new and desired to be protected by Letters Patent is set forth in the appended claims.

I claim:

1. A garment for carrying articles in distributed weight positions on a user including a backpack with integral vest-like front panel comprising:

a) a front panel having front panel top, front panel bottom, and two front panel sides;

i) a front panel pouch attached to said front panel, said front panel pouch extending substantially across said front panel, ii) said front panel pouch having an adustable opening at its top side, a front surface and side and bottom edges attaching said pouch front surface to said front panel, iii) an adjustable front panel pouch gather tie means formed into said adjustable opening of said pouch for adjustably closing said front panel pouch, b) a back panel having back panel rear backside pack, a back panel top, a back panel bottom, and two back panel sides, said backside pack extending along said back panel from adjacent to said back panel top to said back panel bottom and having an adjustably closable upper opening, i) said back panel rear backside pack having an open mesh exterior surface pouch attached to its exterior surface, said pouch having top, bottom and sides, ii) said mesh exterior surface pouch having an open top and being attached at its bottom to said backside pack at said back panel bottom and at its sides to said two back panel sides, iii) a strap attached to said mesh exterior surface and a buckle attached to said back panel top in cooperating alignment with said strap for adjustably closing said top of said exterior surface pouch, iv) said backside pack adjustably closeable upper opening including a dual zipper means for adjustably closing said backside pack, c) a shoulder bib attaching said front panel top to said back panel top and said shoulder bib having a shoulder bib head opening, i) said shoulder bib being formed with interior padding material where said shoulder bib engages the shoulders of a user, d) said front panel and said back panel being fabricated with an inside layer of a soft pliable material and an outside layer of a waterproof material, e) and a means for adjustably attaching said two front panel sides to said two back panel sides, i) said adjustable attaching means being positioned along said panel sides at a position to attach said side panels about the rib cage of a user and below the arms of a user, f) whereby said garment for carrying provides means for distributing weight of articles in said garment on a user and pouch means with mesh exterior surface for receiving articles, said garment being firmly secureable to a user while allowing the arms of a user to be freely movable.

2. The backpack with integral front vest-like panel as described in claim 1 wherein the means for adjustably attaching is selected from the group of fasteners consisting of clips, side release clamp, belt buckle strap, buttons, push pins, snaps and screw-on means.

3. The backpack with integral front vest-like panel as described in claim 1 wherein the inside layer is manufactured from the group of soft pliable materials consisting of neoprene, cotton, terry cloth, rubber composites, plastic, plastic composites and natural fibers.

* * * * *